US009184020B2

(12) United States Patent
Parker

(10) Patent No.: US 9,184,020 B2
(45) Date of Patent: Nov. 10, 2015

(54) TILTABLE OR DEFLECTABLE ANODE X-RAY TUBE

(71) Applicant: Moxtek, Inc., Orem, UT (US)

(72) Inventor: Todd S. Parker, Kaysville, UT (US)

(73) Assignee: Moxtek, Inc., Orem, UT (US)

( * ) Notice: Subject to any disclaimer, the term of this patent is extended or adjusted under 35 U.S.C. 154(b) by 191 days.

(21) Appl. No.: 14/163,441

(22) Filed: Jan. 24, 2014

(65) Prior Publication Data

US 2014/0247921 A1 Sep. 4, 2014

Related U.S. Application Data

(60) Provisional application No. 61/772,411, filed on Mar. 4, 2013, provisional application No. 61/814,036, filed on Apr. 19, 2013.

(51) Int. Cl.

| | |
|---|---|
| ***H01J 35/00*** | (2006.01) |
| ***H01J 35/24*** | (2006.01) |
| ***H01J 35/10*** | (2006.01) |
| ***H01J 35/14*** | (2006.01) |
| ***H01J 35/28*** | (2006.01) |

(52) U.S. Cl.

CPC ..... *H01J 35/24* (2013.01); *H01J 35/10* (2013.01); *H01J 35/14* (2013.01); *H01J 35/28* (2013.01); *H01J 2235/086* (2013.01); *H01J 2235/087* (2013.01); *H01J 2235/186* (2013.01)

(58) Field of Classification Search

CPC ..... H01J 35/24; H01J 35/28; H01J 35/14; H01J 35/10; H01J 2235/086; H01J 35/04

USPC ..... 378/124, 125, 126, 143

See application file for complete search history.

(56) References Cited

U.S. PATENT DOCUMENTS

| | | | |
|---|---|---|---|
| 1,946,288 | A | 2/1934 | Kearsley |
| 2,298,335 | A | 9/1940 | Atlee |
| 2,291,948 | A | 8/1942 | Cassen |
| 2,316,214 | A | 4/1943 | Atlee et al. |
| 2,329,318 | A | 9/1943 | Atlee et al. |
| 2,549,614 | A | 4/1951 | Leighton |
| 2,683,223 | A | 7/1954 | Hosemann |
| 2,952,790 | A | 9/1960 | Steen |

(Continued)

FOREIGN PATENT DOCUMENTS

| | | |
|---|---|---|
| DE | 1030936 | 5/1958 |
| DE | 4430623 | 3/1996 |

(Continued)

OTHER PUBLICATIONS

U.S. Appl. No. 13/812,102, filed Jan. 24, 2013; Dongbing Wang.

(Continued)

*Primary Examiner* — Michael Maskell

(74) *Attorney, Agent, or Firm* — Thorpe North & Western, LLP

(57) ABSTRACT

A x-ray tube comprising an anode sealed to a flexible coupling. The flexible coupling can allow the anode to deflect or tilt in various directions to allow an electron beam to impinge upon various selected regions of an anode target.

A method of utilizing different regions of an x-ray tube target by tilting or deflecting an x-ray tube anode to cause an electron beam to impinge on a selected region of the target.

20 Claims, 9 Drawing Sheets

(56) References Cited

U.S. PATENT DOCUMENTS

| | | | | |
|---|---|---|---|---|
| 3,679,927 | A | 7/1972 | Kirkendall | |
| 3,751,701 | A | 8/1973 | Gralenski et al. | |
| 3,753,020 | A * | 8/1973 | Zingaro | H01J 35/12 313/149 |
| 3,801,847 | A | 4/1974 | Dietz | |
| 3,882,339 | A | 5/1975 | Rate et al. | |
| 3,900,751 | A | 8/1975 | Holland et al. | |
| 4,007,375 | A | 2/1977 | Albert | |
| 4,075,526 | A | 2/1978 | Grubis | |
| 4,184,097 | A | 1/1980 | Auge | |
| 4,400,822 | A | 8/1983 | Kuhnke et al. | |
| 4,504,895 | A | 3/1985 | Steigerwald | |
| 4,521,902 | A | 6/1985 | Peugeot | |
| 4,573,186 | A | 2/1986 | Reinhold | |
| 4,679,219 | A | 7/1987 | Ozaki | |
| 4,688,241 | A | 8/1987 | Peugeot | |
| 4,734,924 | A | 3/1988 | Yahata et al. | |
| 4,761,804 | A | 8/1988 | Yahata | |
| 4,777,642 | A | 10/1988 | Ono | |
| 4,797,907 | A | 1/1989 | Anderton | |
| 4,870,671 | A | 9/1989 | Hershyn | |
| 4,878,866 | A | 11/1989 | Mori et al. | |
| 4,891,831 | A | 1/1990 | Tanaka et al. | |
| 4,969,173 | A | 11/1990 | Valkonet | |
| 4,979,199 | A | 12/1990 | Cueman et al. | |
| 4,995,069 | A | 2/1991 | Tanaka | |
| 5,077,771 | A | 12/1991 | Skillicorn et al. | |
| 5,077,777 | A | 12/1991 | Daly | |
| 5,105,456 | A | 4/1992 | Rand et al. | |
| 5,187,737 | A | 2/1993 | Watanabe | |
| 5,200,984 | A | 4/1993 | Laeuffer | |
| RE34,421 | E | 10/1993 | Parker et al. | |
| 5,343,112 | A | 8/1994 | Wegmann | |
| 5,347,571 | A | 9/1994 | Furbee et al. | |
| 5,400,385 | A | 3/1995 | Blake et al. | |
| 5,422,926 | A | 6/1995 | Smith | |
| 5,428,658 | A | 6/1995 | Oettinger et al. | |
| 5,469,490 | A | 11/1995 | Golden et al. | |
| RE35,383 | E | 11/1996 | Miller et al. | |
| 5,621,780 | A | 4/1997 | Smith et al. | |
| 5,627,871 | A | 5/1997 | Wang | |
| 5,631,943 | A | 5/1997 | Miles | |
| 5,680,433 | A | 10/1997 | Jensen | |
| 5,682,412 | A | 10/1997 | Skillicorn et al. | |
| 5,696,808 | A | 12/1997 | Lenz | |
| 5,729,583 | A | 3/1998 | Tang et al. | |
| 5,812,632 | A | 9/1998 | Schardt et al. | |
| 5,907,595 | A | 5/1999 | Sommerer | |
| 5,978,446 | A | 11/1999 | Resnick | |
| 6,005,918 | A | 12/1999 | Harris et al. | |
| 6,044,130 | A | 3/2000 | Inazura et al. | |
| 6,075,839 | A | 6/2000 | Treseder | |
| 6,097,790 | A | 8/2000 | Hasegawa et al. | |
| 6,134,300 | A | 10/2000 | Trebes et al. | |
| 6,205,200 | B1 | 3/2001 | Boyer et al. | |
| 6,282,263 | B1 | 8/2001 | Arndt et al. | |
| 6,351,520 | B1 | 2/2002 | Inazaru | |
| 6,385,294 | B2 | 5/2002 | Suzuki et al. | |
| 6,438,207 | B1 | 8/2002 | Chidester et al. | |
| 6,477,235 | B2 | 11/2002 | Chornenky et al. | |
| 6,487,272 | B1 | 11/2002 | Kutsuzawa | |
| 6,487,273 | B1 | 11/2002 | Takenaka et al. | |
| 6,494,618 | B1 | 12/2002 | Moulton | |
| 6,546,077 | B2 | 4/2003 | Chornenky et al. | |
| 6,560,315 | B1 | 5/2003 | Price et al. | |
| 6,567,500 | B2 | 5/2003 | Rother | |
| 6,646,366 | B2 | 11/2003 | Hell et al. | |
| 6,661,876 | B2 | 12/2003 | Turner et al. | |
| 6,778,633 | B1 | 8/2004 | Loxley et al. | |
| 6,799,075 | B1 | 9/2004 | Chornenky et al. | |
| 6,803,570 | B1 | 10/2004 | Bryson, III et al. | |
| 6,816,573 | B2 | 11/2004 | Hirano et al. | |
| 6,819,741 | B2 | 11/2004 | Chidester | |
| 6,876,724 | B2 | 4/2005 | Zhou | |
| 6,944,270 | B1 * | 9/2005 | Kim | H01J 35/24 378/125 |
| 6,976,953 | B1 | 12/2005 | Pelc | |
| 6,987,835 | B2 | 1/2006 | Lovoi | |
| 7,035,379 | B2 | 4/2006 | Turner et al. | |
| 7,046,767 | B2 | 5/2006 | Okada et al. | |
| 7,049,735 | B2 | 5/2006 | Ohkubo et al. | |
| 7,050,539 | B2 | 5/2006 | Loef et al. | |
| 7,085,354 | B2 | 8/2006 | Kanagami | |
| 7,130,380 | B2 | 10/2006 | Lovoi et al. | |
| 7,130,381 | B2 | 10/2006 | Lovoi et al. | |
| 7,203,283 | B1 | 4/2007 | Puusaari | |
| 7,206,381 | B2 | 4/2007 | Shimono et al. | |
| 7,215,741 | B2 | 5/2007 | Ukita | |
| 7,224,769 | B2 | 5/2007 | Turner | |
| 7,286,642 | B2 | 10/2007 | Ishikawa et al. | |
| 7,305,066 | B2 | 12/2007 | Ukita | |
| 7,317,784 | B2 | 1/2008 | Durst et al. | |
| 7,382,862 | B2 | 6/2008 | Bard et al. | |
| 7,428,298 | B2 | 9/2008 | Bard et al. | |
| 7,448,801 | B2 | 11/2008 | Oettinger et al. | |
| 7,448,802 | B2 | 11/2008 | Oettinger et al. | |
| 7,526,068 | B2 | 4/2009 | Dinsmore | |
| 7,529,345 | B2 | 5/2009 | Bard et al. | |
| 7,634,052 | B2 | 12/2009 | Grodzins et al. | |
| 7,649,980 | B2 | 1/2010 | Aoki et al. | |
| 7,657,002 | B2 | 2/2010 | Burke et al. | |
| 7,693,265 | B2 | 4/2010 | Hauttmann et al. | |
| 7,839,254 | B2 | 11/2010 | Dinsmore et al. | |
| 7,983,394 | B2 | 7/2011 | Kozaczek et al. | |
| 8,247,971 | B1 | 8/2012 | Bard | |
| 8,526,574 | B2 | 9/2013 | Wang et al. | |
| 2004/0076260 | A1 | 4/2004 | Charles, Jr. et al. | |
| 2006/0210020 | A1 | 9/2006 | Takahashi et al. | |
| 2006/0280289 | A1 | 12/2006 | Hanington et al. | |
| 2007/0217574 | A1 | 9/2007 | Beyerlein | |
| 2010/0189225 | A1 | 7/2010 | Ernest et al. | |
| 2011/0135066 | A1 | 6/2011 | Behling | |
| 2013/0077758 | A1 | 3/2013 | Miller | |
| 2013/0121472 | A1 | 5/2013 | Wang | |
| 2013/0136237 | A1 | 5/2013 | Wang | |
| 2013/0163725 | A1 | 6/2013 | Hansen et al. | |
| 2013/0170623 | A1 | 7/2013 | Reynolds et al. | |
| 2013/0223109 | A1 | 8/2013 | Wang | |
| 2013/0308757 | A1 | 11/2013 | Wang | |

FOREIGN PATENT DOCUMENTS

| | | |
|---|---|---|
| DE | 19818057 | 11/1999 |
| GB | 1252290 | 11/1971 |
| JP | 5135722 | 6/1993 |
| JP | 08315783 | 11/1996 |
| JP | 2003/007237 | 1/2003 |

OTHER PUBLICATIONS

U.S. Appl. No. 13/217,932, filed Aug. 25, 2011; Dave Reynolds.
U.S. Appl. No. 13/307,579, filed Nov. 30, 2011; Dongbing Wang.
U.S. Appl. No. 13/307,559, filed Nov. 30, 2011; Dongbing Wang.
U.S. Appl. No. 13/625,705, filed Sep. 24, 2012; Dongbing Wang.
U.S. Appl. No. 13/863,144, filed Apr. 15, 2013; Dongbing Wang.
U.S. Appl. No. 13/863,148, filed Apr. 15, 2013; Dongbing Wang.
U.S. Appl. No. 14/038,226, filed Sep. 26, 2013; Dongbing Wang.
http://www.orau.org/ptp/collection/xraytubescollidge/MachelettCW250.htm, 1999, 2 pgs.

* cited by examiner

TILTABLE OR DEFLECTABLE ANODE X-RAY TUBE

CLAIM OF PRIORITY

This claims priority to U.S. Provisional Patent Application No. 61/772,411, filed on Mar. 4, 2013, and to U.S. Provisional Patent Application No. 61/814,036, filed on Apr. 19, 2013, which are hereby incorporated herein by reference in their entirety.

FIELD OF THE INVENTION

The present application is related generally to x-ray sources.

BACKGROUND

X-ray tubes can include a target material for production of x-rays in response to impinging electrons from an electron emitter. It can be advantageous to have multiple target regions, and the ability to selectively direct the electron beam to each region. For example, a new region of the target can be used when a previously used region has worn out or become too pitted for further use. Another advantage is selecting x-ray energy spectra emitted from different target materials in different target regions. For example, if the target includes a silver region and a gold region, x-rays emitted when the electron beam is directed at the silver region will have a different energy spectra than x-rays emitted when the electron beam is directed at the gold region.

Redirecting the electron beam to different regions of the target can be undesirable due to a different resulting direction or location of emitted x-rays. If x-rays are emitted in one direction while using one region of the anode, then emitted in another direction while using another region of the anode, the x-ray user may need to re-collimate and/or realign the x-ray tube with each different use. This need to re-collimate or realign optics can be undesirable.

Information relevant to attempts to address these problems can be found in U.S. Pat. Nos. 3,753,020, 2,298,335, 2,549,614, 6,560,315, 3,900,751, 7,973,394, and 5,655,000; U.S. Patent Publication Number US 2011/0135066; and Japan Patent Number JP 3,812,165.

SUMMARY

It has been recognized that it would be advantageous to allow use of multiple regions of a target in an x-ray tube, while maintaining a stationary electron beam position (i.e. keeping the electron beam directed in a single direction). The present invention is directed to a x-ray tube and a method that satisfy these needs.

The x-ray tube can comprise an electron emitter, a flexible coupling with a coupling axis, and a window hermetically sealed to an enclosure. An anode can be attached to the flexible coupling. The electron emitter can be configured to emit electrons to the anode. The anode can include a target configured to produce x-rays in response to impinging electrons from the electron emitter. The anode can be spaced-apart from the window by a gap through which the x-rays emitted from the target travel to the window. The anode can be selectively tiltable or deflectable in all directions in a 360 degree circle around the coupling axis to selectively position a region of the target material in the electron beam.

The method, of utilizing different regions of an x-ray tube target, can comprise (a) disposing a target in an electron beam, the target being disposed at an end of an anode and configured to produce x-rays in response to impinging electrons; (b) emitting x-rays from the target to an x-ray tube window through a gap between the target and the window; and (c) deflecting or tilting the anode in all directions in a 360 degree circle to selectively position a region of the target in the electron beam.

DETAILED DESCRIPTION

Figure 1:
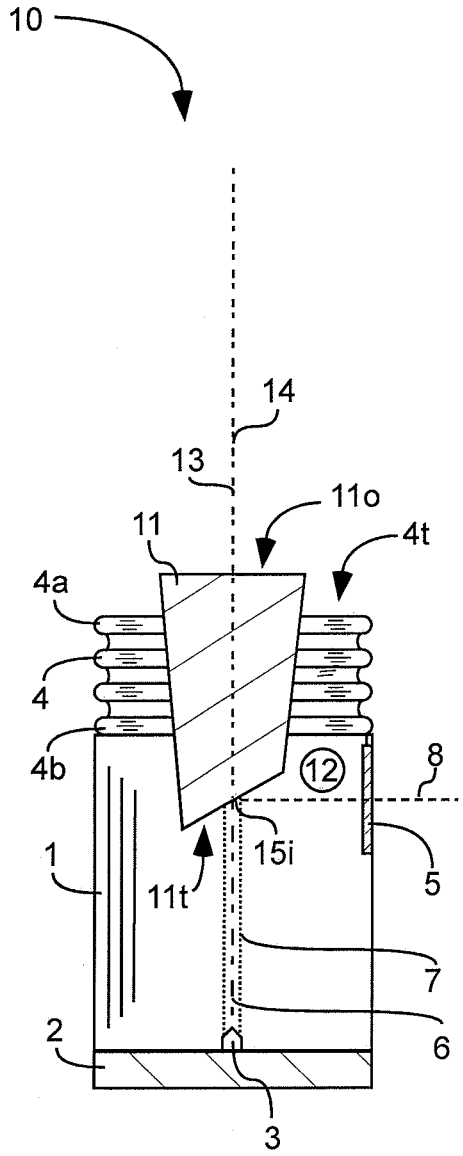
FIG. 1 is a schematic cross-sectional side view of an x-ray tube 10 including an anode 11 attached to a flexible coupling 4 to allow the anode 11 to be selectively tiltable or deflectable, in accordance with an embodiment of the present invention.

As illustrated in FIG. 1 an x-ray tube 10 is shown comprising an electron emitter 3, a flexible coupling 4 with a coupling axis 14, and a window 5 hermetically sealed to an enclosure 1. The flexible coupling can be or can include a bellows.

An anode 11 can be attached to the flexible coupling 4. The anode 11 can extend through a core of the flexible coupling 4. A first end 4*a* of the flexible coupling 4 can be attached to or hermetically sealed to the anode 11 and a second end 4*b* of the flexible coupling 4 can be hermetically sealed to the enclosure 1. The coupling 4 can have a top face 4*t* at the first end 4*a*.

The coupling axis 14 is an imaginary straight reference line. The coupling axis 14 can be disposed at a center of individual coupling rings (if the coupling is a bellows); can extend from the first end 4*a* to the second end 4*b* of the coupling 4; and can be disposed at a center of the top face 4*t* and perpendicular to a plane of the top face 4*t*. The coupling axis 14 is defined with the coupling 4 in an unflexed condition. Thus, the coupling axis 14 will not bend or change position as the coupling 4 is flexed.

The electron emitter 3 can be configured to emit electrons 7 from the electron emitter 3 to the anode 11. The electron emitter 3 can be part of or can be attached to a cathode 2. The electron emitter 3 can emit electrons to the anode 11 due to a high electron emitter 3 temperature and a large voltage differential between the electron emitter 3 and the anode 11. An electron beam axis 6 can be an approximate center of the electron beam. The anode 11 can include a target material configured to produce x-rays 8 in response to impinging electrons from the electron emitter 3.

The anode 11 can be spaced-apart from the window 5 by a gap 12 through which the x-rays 8 emitted from the target travel to the window 5. The gap 12 can be a hollow portion of the enclosure between the anode 11 and the window 5. The gap 12 can be an evacuated inner portion of the enclosure 1.

Figure 2:
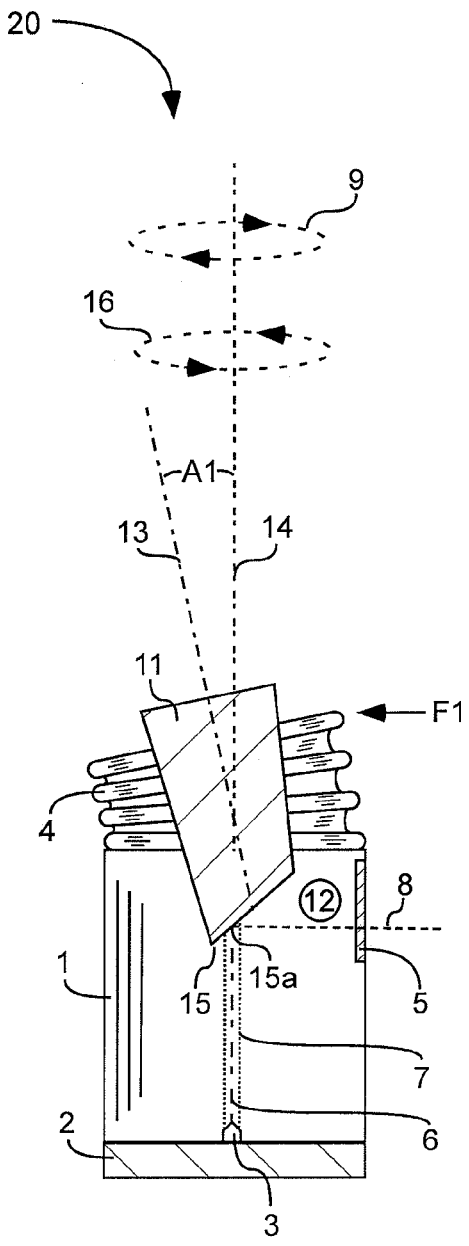
FIGS. 2-3 are schematic cross-sectional side views of an x-ray tube 20 including an anode 11 attached to a flexible coupling 4, the anode 11 tilted at an acute angle A1 with respect to a coupling axis 14, in accordance with an embodiment of the present invention.
Figure 3:
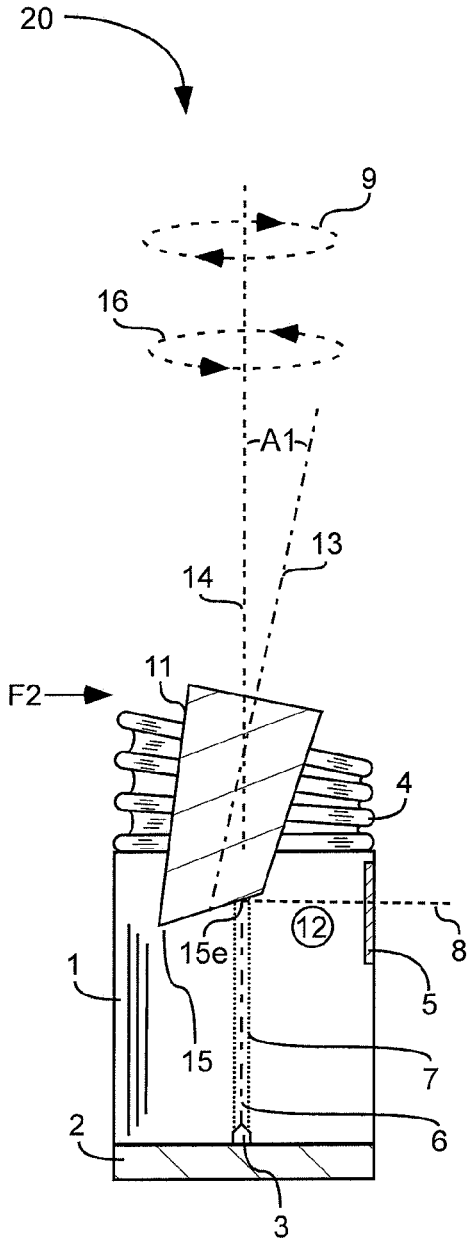

The anode 11 of x-ray tube 10 in FIG. 1 can deflect or tilt to allow exposure of different regions 15 of the target to the electron beam 7. A tilted anode 11, and an acute angle A1 between the coupling axis 14 and the anode axis 13, is shown in FIGS. 2-3 on x-ray tube 20. The anode 11 of x-ray tube 20 can be selectively tiltable in all directions in a 360 degree circle 9 or 16 around the coupling axis 14 to selectively position a region 15 of the target in the electron beam 7. In other words, the anode can be selectively tiltable in all directions from the coupling axis 14 outward to a circle 9 or 16 around and perpendicular to the coupling axis 14 to selectively position a region 15 of the target material in the electron beam 7.

The anode 11 can include a longitudinal anode axis 13. The anode axis 13 can extend from an anode face on which the target material is deposited (target face 11*t*) to an opposite, outward face 11*o* or end. The target face 11*t* can be tilted at an acute angle A1 with respect to the electron beam axis 6. The target face lit can be tilted towards the window 5 to allow x-rays 8 emitted from the target to transmit through the window 5. The target material can face the electron emitter 3 and the window 5 in all directions in which the anode 11 is tilted.

On x-ray tube 10 in FIG. 1, the anode 11 is not tilted or deflected, the anode axis 13 is aligned with the coupling axis 14, and the electron beam 7 is impinging on a central region 15*i* of the target. As shown on x-ray tube 20 in FIG. 2, the anode 11 can be positioned with the electron beam 7 and electron beam axis 6 impinging on a non-central region 15*a* of the target; then as shown on x-ray tube 30 in FIG. 3, the anode 11 can be tilted in another direction to cause the electron beam 7 and electron beam axis 6 to impinge on a different non-central region 15*e* of the target. On x-ray tube 20 in FIG. 2, a force F1 forces the coupling to flex to a side, and tilts the upper end of the anode axis 13 to the left of the coupling axis 14, causing an acute angle A1 between the anode axis 13 and the coupling axis 14. This tilt can align a different region 15*a* of the target with the electron beam 7. On x-ray tube 20 in FIG. 3, a force F2 tilts the upper end of the anode axis 13 to the right of the coupling axis 14 causing an acute angle A1 between the anode axis 13 and the coupling axis 14. This tilt can align a different region 15*e* of the target with the electron beam 7. By applying a force F in different directions in a 360 degree circle 9 or 16 perpendicular to and around the coupling axis 14, the acute angle A1 can orbit around the coupling axis by flexing the coupling in different directions.

Figure 4:
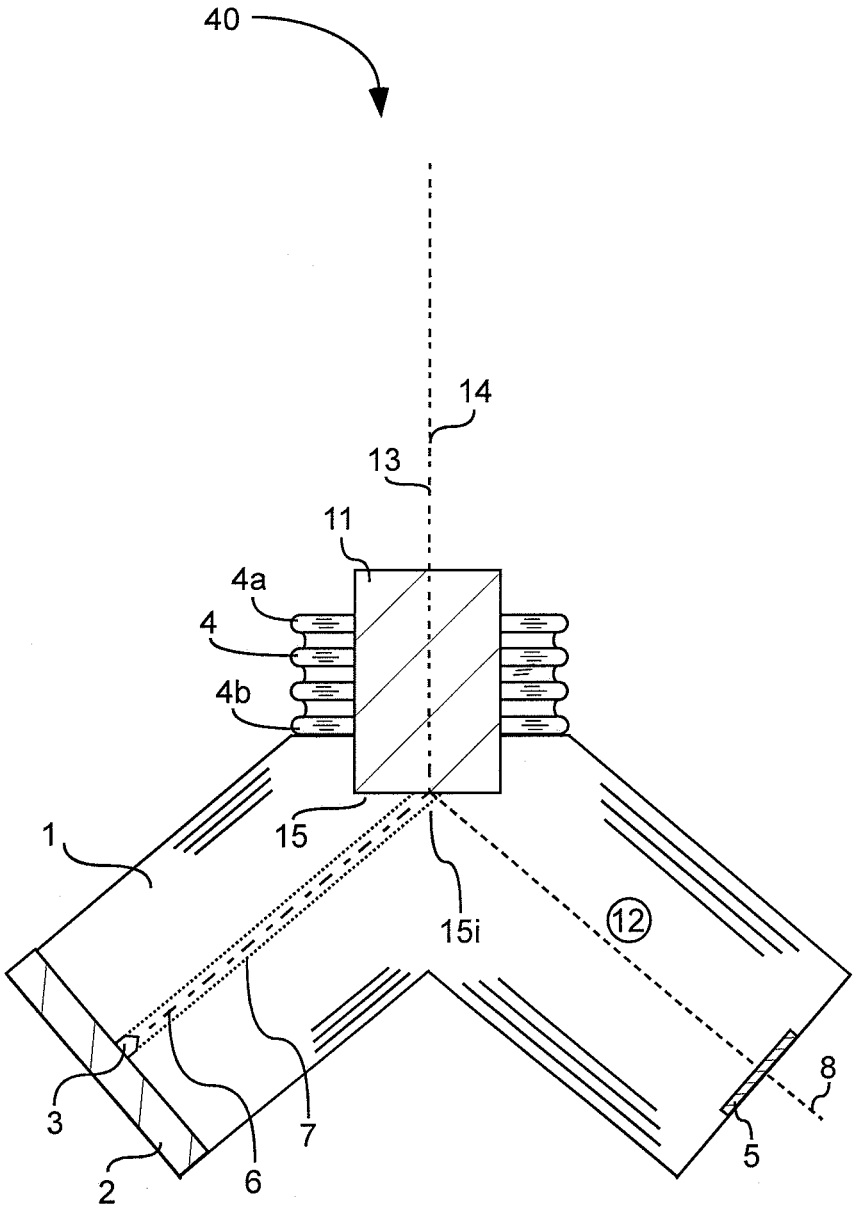
FIG. 4 is a schematic cross-sectional side view of an x-ray tube 40 including an anode 11 attached to a flexible coupling 4 to allow the anode 11 to be selectively tiltable or deflectable, the anode 11 and flexible coupling 4 disposed at a mid-point of the tube between an electron emitter 3 and a window 5, in accordance with an embodiment of the present invention.
Figure 5:
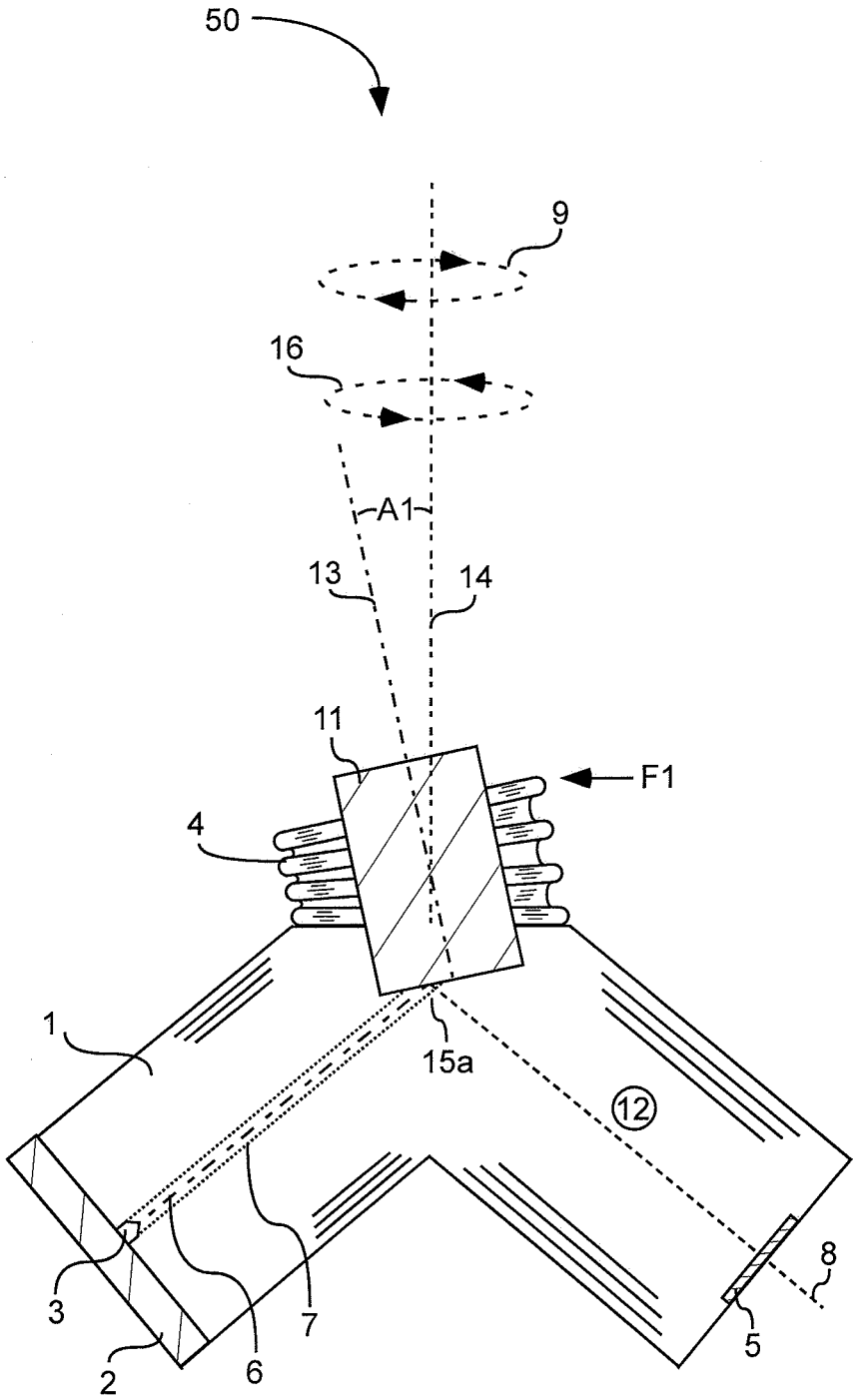
FIGS. 5-6 are schematic cross-sectional side views of an x-ray tube 50 including an anode 11 attached to a flexible coupling 4, the anode 11 tilted at an acute angle A1 with respect to a coupling axis 14, the anode 11 and flexible coupling 4 disposed at a mid-point of the tube between an electron emitter 3 and a window 5, in accordance with an embodiment of the present invention.
Figure 6:
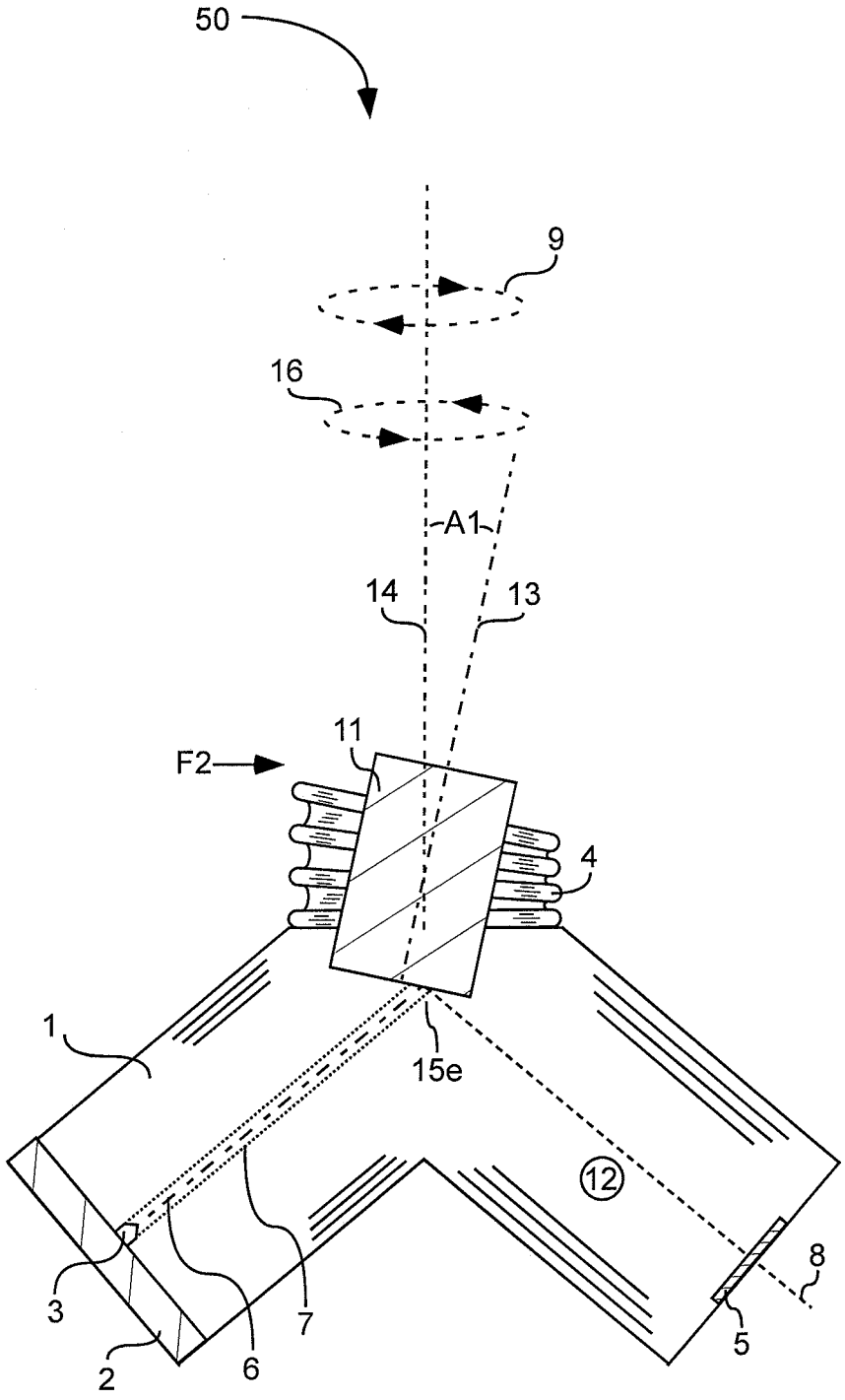

As shown in FIGS. 1-3, the electron emitter 3 can be disposed at one end of the enclosure 1, the anode 11 can be disposed at an opposite end of the enclosure 1, and the window 5 can be a side-window disposed along a side of the enclosure 1 between the electron emitter 3 and the anode 11. As shown in FIGS. 4-6, the concept of a flexible coupling 4 attached to the anode 11 can be used in a modified design. The electron emitter 3 can be disposed at one end of the enclosure 1, the window 5 can be disposed at an opposite end of the enclosure 1, and the anode 11 can be disposed along a side of the enclosure 1 between the electron emitter 3 and the window 5. Manufacturability, cost, size constraints, and a need to have the x-ray tube closer to a sample can affect an engineer's decision of whether to select a design like that shown in FIGS. 1-3 or like that shown in FIGS. 4-6.

The anode 11 of x-ray tube 40 in FIG. 4 can deflect or tilt to allow exposure of different regions 15 of the target to the electron beam 7. A tilted anode 11, and an acute angle A1 between the coupling axis 14 and the anode axis 13, is shown in FIGS. 5-6 on x-ray tube 50. Similar to x-ray tube 20 in FIGS. 2-3, the anode 11 of x-ray tube 50 in FIGS. 5-6 can be selectively tiltable in all directions in a 360 degree circle 9 or 16 perpendicular to and around the coupling axis 14 to selectively position a region 15 of the target in the electron beam 7. The target material can face the electron emitter 3 and the window 5 in all directions in which the anode 11 is tilted.

Figure 7:
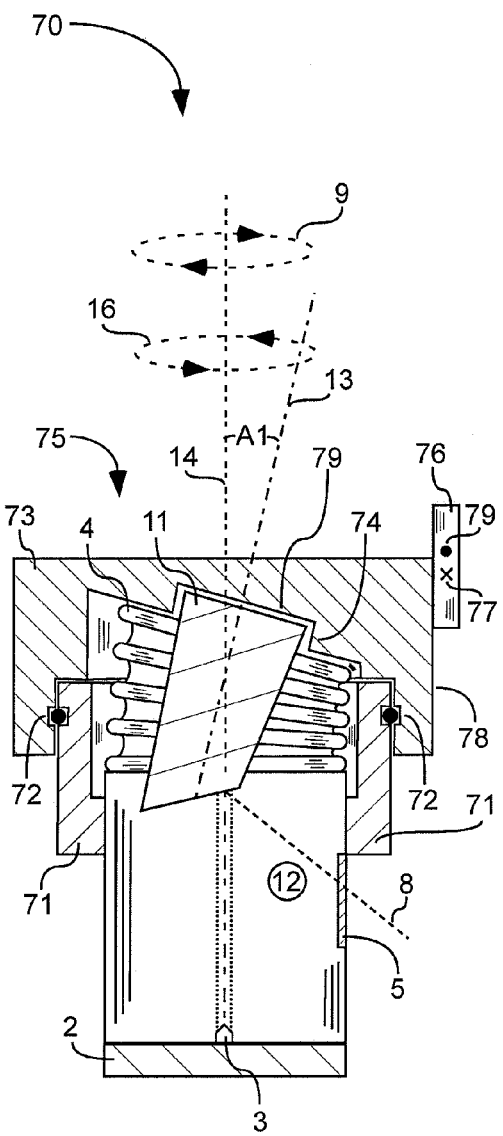
FIGS. 7-8 are schematic cross-sectional side views of an x-ray tube 70 including an anode 11 attached to a flexible coupling 4, the anode 11 tilted at an acute angle A1 with respect to a coupling axis 14, a ring 73 rotatably coupled around the flexible coupling 4, rotation of the ring 73 causing the anode 11 to tilt in different directions to allow the acute angle A1 of the anode 11 to orbit around the coupling axis 14, in accordance with an embodiment of the present invention.
Figure 8:
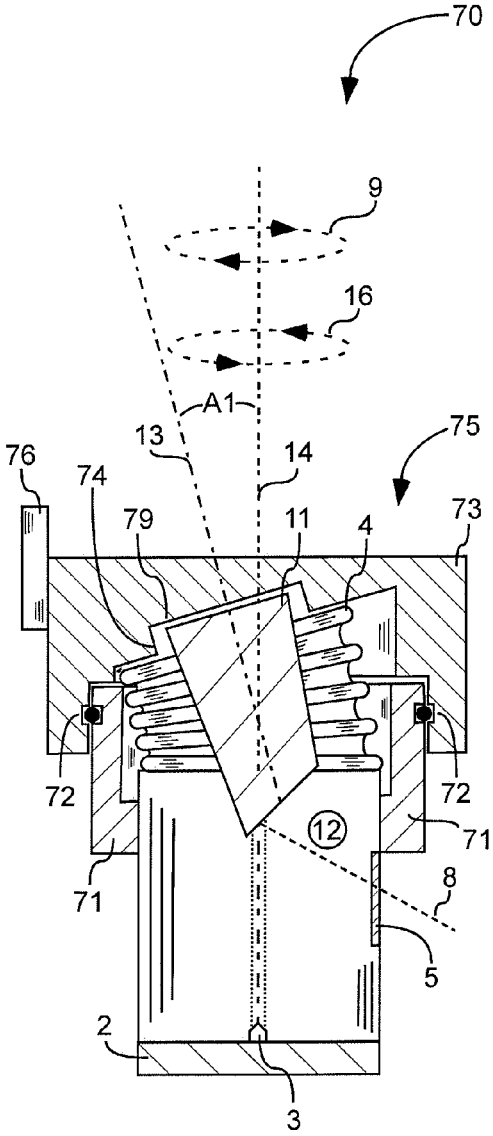

One device or means for tilting the anode 11 in different directions is shown on x-ray tube 70 in FIGS. 7-8. A ring 73 can be rotatably coupled around the flexible coupling 4. The ring 73 can include a cavity 74. The anode 11 can extend from an interior of the enclosure 1, through a core of the flexible coupling 4, and into the cavity 74. The cavity 74 can be sized and shaped to receive and engage the anode 11. The cavity 74 can be eccentric or offset with respect to a center of the ring 73. The cavity 74 can cause the anode 11 to tilt at an acute angle A1 with respect to the coupling axis 14. Rotation of the ring 73 can cause the anode 11 to tilt in different directions to allow the acute angle A1 of the anode 11 to orbit around the coupling axis 14.

A ring support 71 can be attached to the enclosure 1. The ring 73 can rotate around the ring support 71. The ring support 71 can include a channel and the ring 73 can include a mating channel. A fastening device 72 can be used to attach the ring 73 to the ring support, and allow the ring 73 to rotate around the ring support 71. Examples of possible fastening devices 72 include a snap ring, ball bearings, or an e clip. Lubricant in the channels can minimize friction as the ring 73 rotates around the ring support 71.

In one embodiment, the cavity 74 can include a slanted face 79 facing an end portion of the anode 11. The slanted face 79 can be tilted at an acute angle with respect to the coupling axis 14. The slanted face 79 can cause the anode 11 to tilt at the acute angle. Use of this design can cause the anode 11 to tilt at a single acute angle as this acute angle orbits in a 360 degree circle 9 or 16 around the coupling axis 14.

The ring 73 can include a device 76, such as a handle on the ring 73 configured to allow an operator to rotate the ring 73 to different positions, or an electromechanical mechanism configured to rotate the ring 73 to different positions based on input from an operator. The ring 73 can have gears that intermesh with a gear drive mechanism for rotating the ring 73. A force on the device 76 out 79 of the page, tangential to a side 78 of the ring 73, can cause the ring 73 to rotate clockwise with respect to a top face 75 of the ring 73. Continued force on the device 76 tangential to a side 78 of the ring 73 can cause the acute angle A1 between the anode axis 13 and the coupling axis 14 to orbit around the coupling axis 14 to a different position, such as for example the position shown in FIG. 8. Thus, as the ring 73 rotates, the acute angle can orbit in a 360 degree circle 9 (clockwise with respect to a top face 75 of x-ray tube 70) around the electron beam axis 6.

A force on the device 76 into 77 the page, tangential to a side 78 of the ring 73, can cause the ring 73 to rotate counter-clockwise with respect to a top face 75 of x-ray tube 70. Continued force tangential to a side 78 of the ring 73 can cause the acute angle A1 to orbit around the coupling axis 14 to a different position. Thus, as the ring 73 rotates, the acute angle A1 can orbit in a 360 degree circle 16 (counter-clockwise with respect to a top face 75 of x-ray tube 70) around the coupling axis 14.

Use of the ring can keep the anode 11 tilted at a single angle A1 regardless of the direction of tilt. Thus, the anode 11 can maintain substantially the same angle A1 with respect to the coupling axis 14 while the acute angle A1 orbits in a 360 degree circle 9 or 16 around the coupling axis 6. The amount of tilt can be altered by the extent of eccentricity of the cavity 74 and/or by the angle of the slanted face 79.

The ring 73 can be a rotational means for applying force F to the anode 11 from any direction in a 360 degree circle 9 or 16 around and perpendicular with the coupling axis 14. The force F from the rotational means can be capable of causing the anode 11 to tilt at the acute angle A1 in any direction in the 360 degree circle 9 or 16.

Although the ring 73 and other associated devices were shown on a side-window 5 type design, use of the ring and associated devices may be used on the embodiments shown in FIGS. 4-6. Thus, the ring 73 and other associated devices may be used for anode tilt or deflection in an x-ray tube having the anode on a side of the enclosure 1 between the electron emitter 3 and the window 5. The discussion of the ring 73 and other associated devices are incorporated herein by reference and applied to the discussion of x-ray tubes 40 and 50.

Figure 9:
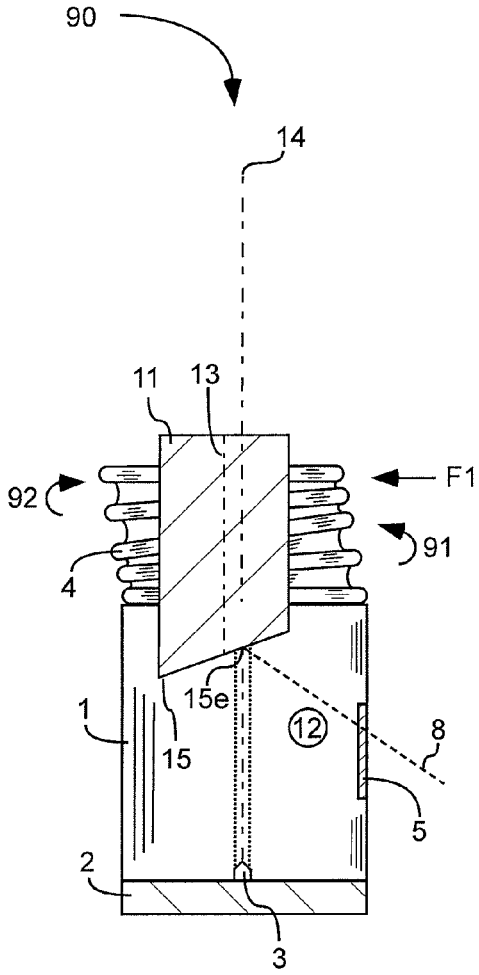
FIG. 9 is schematic cross-sectional side view of an x-ray tube 90 including an anode 11 attached to a flexible coupling 4, the anode 11 deflected with respect to a coupling axis 14, in accordance with an embodiment of the present invention.

As mentioned above in reference to x-ray tube 10 in FIG. 1 and x-ray tube 40 in FIG. 4, motion of the anode 11, for exposing different regions 15 of the target to the electron beam 7, is not limited to tilting. The anode 11 can also deflect without tilting, as shown in FIG. 9, to allow exposure of different regions 15 of the target to the electron beam 7. The anode 11 of x-ray tubes 10 and 40 can be selectively deflectable in all directions in a 360 degree circle 9 or 16 around the coupling axis 14 to selectively position a region 15 of the target in the electron beam 7. In other words, the anode can be selectively deflectable in all directions from the coupling axis 14 outward to a circle 9 or 16 around and perpendicular to the coupling axis 14 to selectively position a region 15 of the target material in the electron beam 7. X-ray tube 90 in FIG. 9 is one example of such deflection.

The anode 11 can be positioned with the electron beam axis 6 impinging on one non-central region 15 of the target; then the anode 11 can be deflected to cause the electron beam axis 6 to impinge on a different non-central region 15 of the target. On x-ray tube 90 in FIG. 9, a force F1 deflects the anode axis 13 to the left of the coupling axis 14 to align region 15*e* of the target with the electron beam 7. By applying a force F in different directions in a 360 degree circle 9 or 16 around the coupling axis 14, the anode axis 13 can orbit around the coupling axis 14 by flexing the coupling 4 in different directions.

Tilting the anode rather than deflecting can be preferable due to decreased stress on the flexible coupling 4. Tilting the flexible coupling 4 can cause a flexure in only one direction. Deflecting, without tilting, as shown in FIG. 9, can cause a dual flexure—the flexible coupling 4 flexes left or counter-clockwise 91 and also flexes right or clockwise 92. Added stress due to dual flexure can decrease coupling life.

The design of FIG. 9, however, may have some advantages over the tilted anode 11 designs. For example, in some applications it may be desirable to keep a constant angle of contact between the electron beam and the target. Also, manufacturing, allowed x-ray tube space, and/or material cost considerations may make this design preferable. If a highly flexible coupling 4 is used, then this deflected anode 11 design becomes more feasible.

Figure 10:
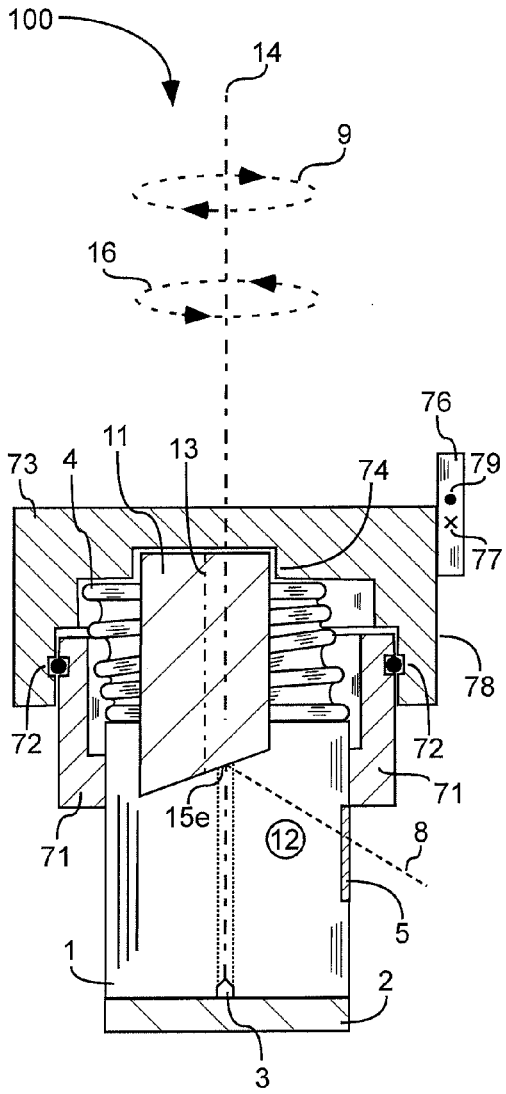
FIG. 10 is schematic cross-sectional side view of an x-ray tube 100 including an anode 11 attached to a flexible coupling 4, the anode 11 deflected with respect to a coupling axis 14, a ring 73 rotatably coupled around the flexible coupling 4, rotation of the ring 73 causing the anode 11 to deflect in different directions to allow an anode axis 13 to orbit around the coupling axis 14, in accordance with an embodiment of the present invention.

One device or means for deflecting the anode 11 in different directions is shown on x-ray tube 100 in FIG. 10. A ring 73 can be rotatably coupled around the flexible coupling 4. The ring 73 can include a cavity 74. The anode 11 can extend from an interior of the enclosure 1, through a core of the flexible coupling 4, and into the cavity 74. The cavity 74 can be sized and shaped to receive and engage the anode 11. The cavity 74 can be eccentric or offset with respect to a center of the ring 73. The cavity 74 can cause the anode 11 to deflect with respect to the coupling axis 14. Rotation of the ring 73 can cause the anode 11 to deflect in different directions to allow the anode axis 13 to orbit around the coupling axis 14. Discussion above of the ring support 71 and the fastening device 72 is incorporated herein by reference.

The above discussion regarding a device 76 to rotate the ring 73 is incorporated herein by reference with the exception of the following modified section. A force on the device 76 out 79 of the page, tangential to a side 78 of the ring 73, can cause the ring 73 to rotate clockwise with respect to a top face 75 of the ring 73. Continued force on the device 76 tangential to a side 78 of the ring 73 can cause the anode axis 13 to orbit around the coupling axis 14 to a different position, or to orbit in a 360 degree circle 9 (clockwise with respect to a top face 75 of x-ray tube 70) around the electron beam axis 6. A force on the device 76 into 77 the page, tangential to a side 78 of the ring 73, can cause the ring 73 to rotate counter-clockwise with respect to a top face 75 of x-ray tube 70. Continued force tangential to a side 78 of the ring 73 can cause the anode axis 13 to orbit around the coupling axis 14 to a different position. Thus, as the ring 73 rotates, the anode axis 13 can orbit in a 360 degree circle 16 (counter-clockwise with respect to a top face 75 of x-ray tube 70) around the coupling axis 14.

The designs in FIGS. 9-10 include a window 5 disposed on a side of the enclosure between the electron emitter 3 and the anode 11. The embodiments shown in FIGS. 9-10, with anode deflection, can be applied to x-ray tube 40 of FIG. 4. Thus, x-ray tube 40 can deflect rather than tilt. The anode axis 13 of x-ray tube 40 can orbit in a 360 degree circle 9 or 16 around the coupling axis 14.

Figure 11:
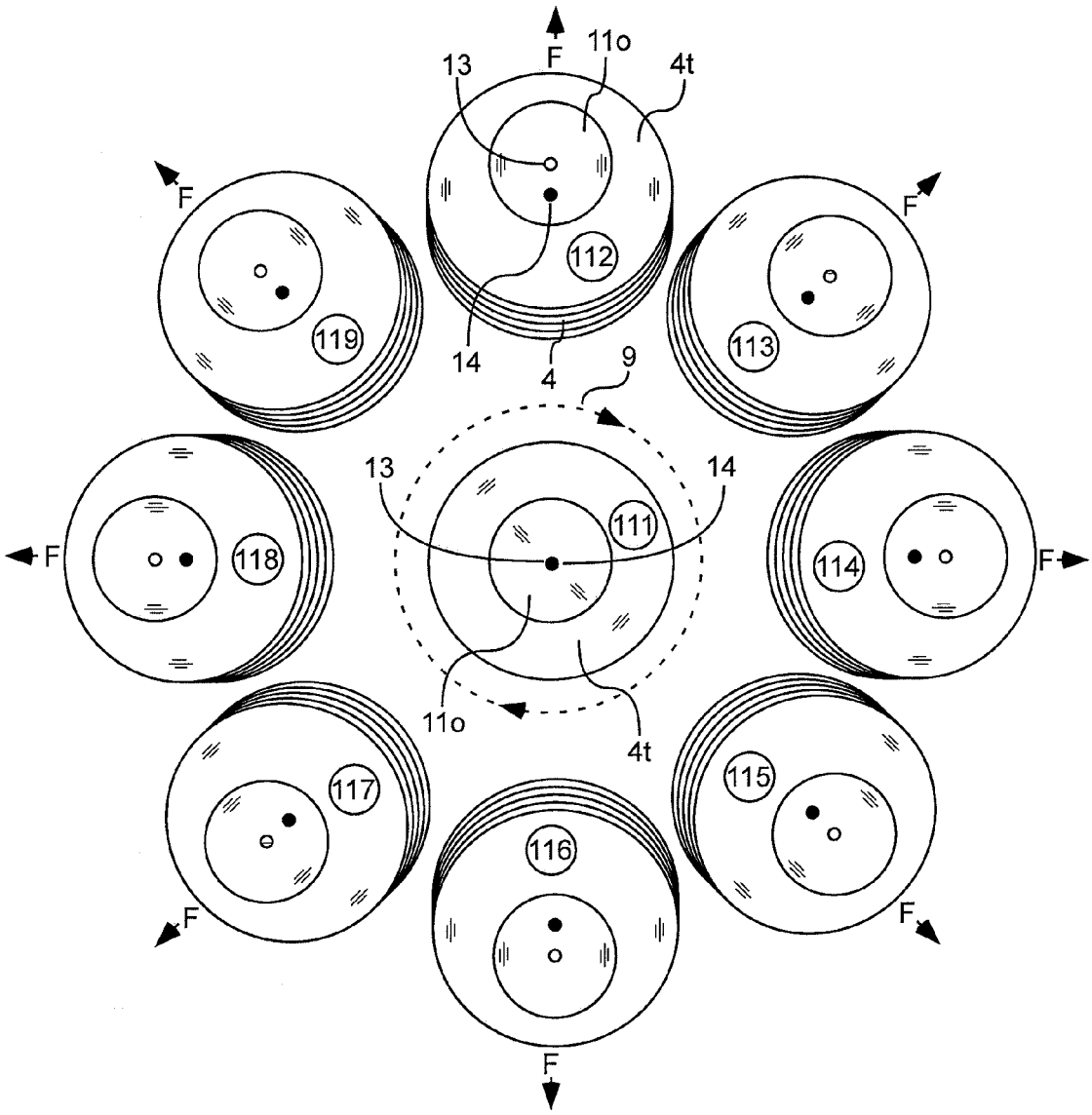
FIG. 11 is a schematic end view of an x-ray tubes 111-119 including an anode 11 attached to a flexible coupling 4, the anode 11 tilted or deflected with respect to a coupling axis 14 to allow an electron beam 7 to impinge on different regions 15 of a target on the anode 11, and to allow an acute angle A1 or an anode axis 13 to orbit around a coupling axis 14, in accordance with an embodiment of the present invention.

Shown in FIG. 11 are x-ray tubes 111-119 with the coupling 4 in different positions. The only parts of the x-ray tubes 111-119 shown in FIG. 11 are the top face 4*t* of the coupling 4 at the first end 4*a*, the outward face 11*o* of the anode 11, an end view of the coupling axis 14 (shown as a solid circle), and an end view of the anode axis 13 (shown as a hollow circle). X-ray tube 111 is shown with no force F applied, and thus the anode axis 13 aligns with the coupling axis 14. The other x-ray tubes 112-119 are shown with a force F in different directions, causing the coupling 4 to flex in different directions, and thus causing the anode to tilt or deflect in different directions. As the anode 11 tilts in different directions, an acute angle between the anode axis 13 and the coupling axis 14 can orbit around the coupling axis 14. Alternatively, as the anode 11 deflects in different directions, the anode axis 13 can orbit around the coupling axis 14.

Use of various target regions 15 has been discussed. There are multiple advantages to having an ability to use different regions 15 of the target (i.e. allowing the electron beam 7 to impinge on different regions 15 of the target at different times). One advantage is to allow use of a new region 15 of the target when a previously used region 15 has worn out or become too pitted for further use.

Figure 12:
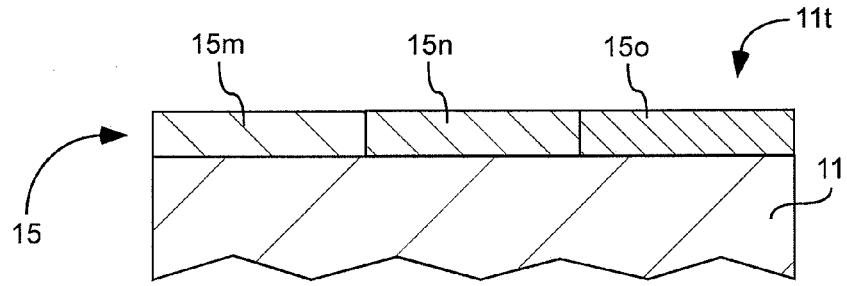
FIG. 12 is a schematic cross-sectional side view of a target face 11*t* end of an anode 11, and multiple target regions 15*m-o* on the target face 11*t*, including at least two different target materials, in accordance with an embodiment of the present invention.

Another advantage is to allow for different x-ray energy spectra, which can be done by use of different target materials in different target regions 15. Shown in FIG. 12 is the target face 11*t* end of the anode 11 and multiple target regions 15*m-o*. Each region 15*m-o* can include a different target material. For example, region 15*m* can be silver, region 15*n* can be gold, and region 15*o* can be tungsten. X-rays 8 emitted when the electron beam 7 is directed at the silver region 15*m* can have a different energy spectra than x-rays 8 emitted when the electron beam 7 is directed at the gold region 15*n*, or than x-rays 8 emitted when the electron beam 7 is directed at the tungsten region 15*o*. Thus, the target can include at least two different regions 15, each region 15 having a different target material than at least one other region 15; and the different target materials can be configured to change a characteristic of the x-rays 8 emitted therefrom.

Figure 13:
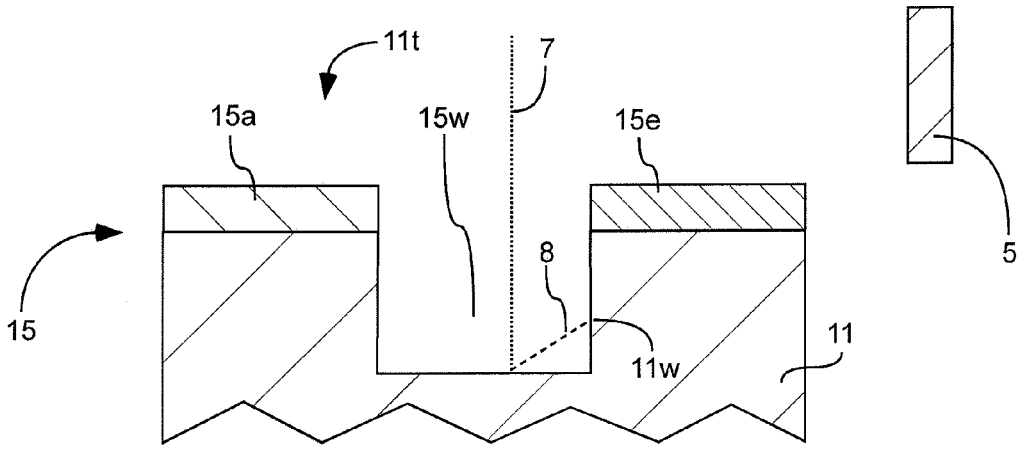
FIGS. 13-14 are a schematic cross-sectional side views of a target face 11*t* end of an anode 11, and multiple target regions 15*a*, 15*e*, and 15*w* on the target face 11*t*, including at least one at least one cavity-shaped target well region 15*w* configured to block x-rays from being emitted through the window 5, in accordance with an embodiment of the present invention.

X-ray tube users sometimes want to temporarily stop the emission of x-rays, such as when the user is moving from one location to another or recording data. Temporarily shutting off the x-ray tube can be undesirable—subsequent x-ray tube start up can take time and x-ray emission may differ due to changes in temperature or electronics of the unit. Shown in in FIG. 13 is a target design including a target well region 15*w* that can allow a user to temporarily prevent emission of x-rays without shutting off the x-ray tube. This can allow greater stability of use in spite of temporary interruptions and can save time.

The target well region 15*w* can be a cavity or a well. The target well region 15*w* can be made of the same material as the anode 11—no additional material added. Alternatively, the target well region 15*w* can have an additional material added. The additional material added can be the same as another region. Whether to add additional target material to the target well region 15*w* can depend on the effect of x-rays 8 emitted from the target well region 15*w* on other x-ray tube components and on manufacturability considerations.

Figure 14:
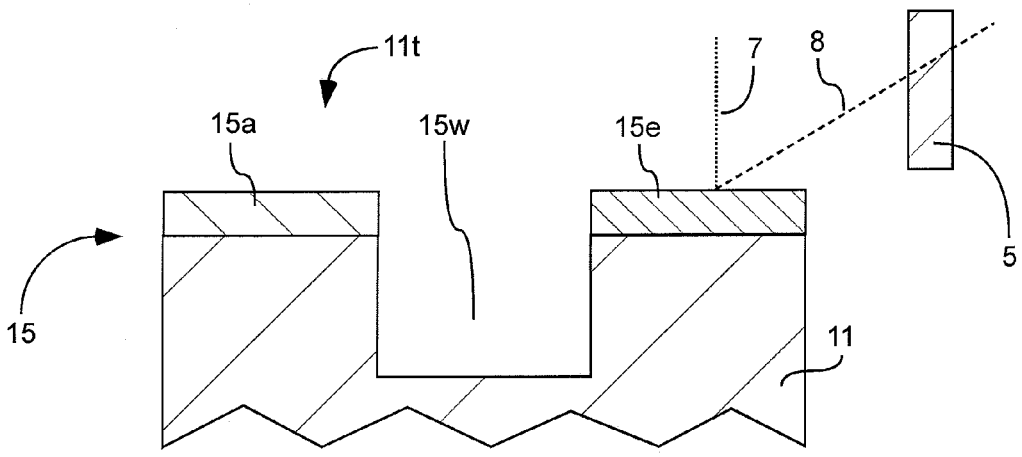

X-rays 8 emitted from the target well region 15*w* can be blocked by walls 11*w* of the cavity or well. By tilting or deflecting the anode 11 to direct the electron beam 7 toward the target well region 15*t*, the x-ray tube can remain powered on without emission of x-rays 8. As shown in FIG. 14, upon tilting or deflecting the anode 11 to direct the electron beam 7 toward another target region 15*e*, x-rays 8 can again emit from the x-ray tube. Allowing the user to stop and start emission of x-rays 8 without powering the unit off and on can save time and can provide stability and consistency over multiple uses.

In various embodiments described herein, various regions 15 of the target can be used while maintaining a stationary electron beam 7 position. The electron beam 7 need not shift to impinge on different target regions 15. This can allow the x-ray user to change to a different target region 15 without the need to re-collimate and/or realign the x-ray tube with each different use.

A method of utilizing different regions 15 of an x-ray tube target can comprise (1) disposing a target in an electron beam 7, the target being disposed on a target face 11*t* end of an anode 11 and configured to produce x-rays 8 in response to impinging electrons 7; (2) emitting x-rays 8 from the target to an x-ray tube window 5 through a gap 12 between the target and the window 5; and (3) deflecting or tilting the anode 11 in all directions in a 360 degree circle 9 or 16 to selectively position a region 15 of the target in the electron beam 7.

What is claimed is:

1. An x-ray tube comprising:

a. an electron emitter, a flexible coupling with a coupling axis, and a window hermetically sealed to an enclosure;

b. an anode attached to the flexible coupling;

c. the electron emitter configured to emit electrons from the electron emitter to the anode;

d. the anode including a target configured to produce x-rays in response to impinging electrons from the electron emitter;

e. the anode spaced-apart from the window by a gap through which the x-rays emitted from the target travel to the window;

f. the anode being selectively tiltable in all directions from the coupling axis outward to a circle around the coupling axis to selectively position a region of the target material in the electron beam.

2. The x-ray tube of claim 1, wherein the anode extends through a core of the flexible coupling.

3. The x-ray tube of claim 1, wherein a first end of the flexible coupling is hermetically sealed to the enclosure and a second end of the flexible coupling is attached to the anode.

4. The x-ray tube of claim 1, wherein the target material faces the electron emitter and the window in all directions in which the anode is tilted.

5. The x-ray tube of claim 1, wherein the electron emitter is disposed at one end of the enclosure, the anode is disposed at an opposite end of the enclosure, and the window is a side-window disposed along a side of the enclosure between the electron emitter and the anode.

6. The x-ray tube of claim 1, wherein the electron emitter is disposed at one end of the enclosure, the window is disposed at an opposite end of the enclosure, and the anode is disposed along a side of the enclosure between the electron emitter and the window.

7. The x-ray tube of claim 1, wherein the target is disposed on a target face portion of the anode, the target face is tilted at an acute angle with respect to an electron beam axis defined by electrons traveling from the electron emitter to the anode, and the target face is tilted towards the window.

8. The x-ray tube of claim 1, wherein:

a. the target includes at least two different regions;

b. at least one of the regions is a target well region including a cavity; and c. the target well region is configured to block x-rays from being emitted through the window.

9. The x-ray tube of claim 1, wherein the target includes at least two different regions, each region having a different target material than at least one other region, the different target materials configured to change a characteristic of the x-rays emitted therefrom.

10. The x-ray tube of claim 1, wherein:

a. an electron beam axis extends, at an approximate center of the electron beam, between the electron emitter and the anode;

b. the anode is positioned with the electron beam axis impinging on a non-central region of the target; and c. tilting the anode in another direction causes the electron beam axis to impinge on a different non-central region of the target.

11. The x-ray tube of claim 1, wherein:

a. a longitudinal anode axis forms an acute angle with respect to the coupling axis as the coupling is flexed to a side; and b. the acute angle orbits around the coupling axis by flexing the coupling in different directions.

12. The x-ray tube of claim 1, further comprising:

a. a ring rotatably coupled around the flexible coupling;

b. the ring including a cavity;

c. the anode extends from an interior of the enclosure, through a core of the flexible coupling, and into the cavity;

d. the cavity sized and shaped to receive and engage the anode;

e. the cavity being offset with respect to a center of the ring;

f. the cavity causing the anode to tilt at an acute angle with respect to the coupling axis; and g. rotation of the ring causing the anode to tilt in different directions to allow the acute angle of the anode to orbit around the coupling axis.

13. An x-ray tube comprising:

a. an electron emitter, a flexible coupling with a coupling axis, and a window hermetically sealed to an enclosure;

b. an anode attached to, and extending through a core of, the flexible coupling;

c. the electron emitter configured to emit electrons from the electron emitter to the anode;

d. the anode including a target configured to produce x-rays in response to impinging electrons from the electron emitter;

e. the anode spaced-apart from the window by a gap through which the x-rays emitted from the target travel to the window;

f. the anode being selectively deflectable in all directions from the coupling axis outward to a circle around the coupling axis to selectively position a region of the target material in the electron beam.

14. The x-ray tube of claim 13, a. a ring rotatably coupled around the flexible coupling;

b. the ring including a cavity;

c. the anode extends from an interior of the enclosure, through a core of the flexible coupling, and into the cavity;

d. the cavity sized and shaped to receive and engage the anode;

e. the cavity causing the anode to deflect with respect to the coupling axis; and f. rotation of the ring causing the anode to deflect in different directions to allow an anode axis to orbit around the coupling axis.

15. The x-ray tube of claim 13, wherein the electron emitter is disposed at one end of the enclosure, the anode is disposed at an opposite end of the enclosure, and the window is a side-window disposed along a side of the enclosure between the electron emitter and the anode.

16. The x-ray tube of claim 13, wherein the electron emitter is disposed at one end of the enclosure, the window is disposed at an opposite end of the enclosure, and the anode is disposed along a side of the enclosure between the electron emitter and the anode.

17. The x-ray tube of claim 13, wherein:

a. the target includes at least two different regions;

b. at least one of the regions is a target well region including a cavity substantially lower than an adjacent target region; and c. the target well region configured to block x-rays from being emitted through the window.

18. The x-ray tube of claim 13, wherein the target includes at least two different regions, each region having a different target material than at least one other region, the different target materials configured to change a characteristic of the x-rays emitted therefrom.

19. The x-ray tube of claim 13, wherein:

a. an electron beam axis extends between the electron emitter and the anode at an approximate center of the electron beam;

b. the anode is positioned with the electron beam axis impinging on a non-central region of the target; and c. deflecting the anode in another direction causes the electron beam axis to impinge on a different non-central region of the target.

20. A method of utilizing different regions of an x-ray tube target, the method comprising:

a. disposing a target in an electron beam, the target being disposed at an end of an anode and configured to produce x-rays in response to impinging electrons;

b. emitting x-rays from the target to an x-ray tube window through a gap between the target and the window;

c. deflecting or tilting the anode in all directions in a 360 degree circle to selectively position a region of the target in the electron beam.

* * * * *